US006235160B1

(12) United States Patent
Tietz et al.

(10) Patent No.: US 6,235,160 B1
(45) Date of Patent: May 22, 2001

(54) MACHINE AND PROCESS FOR PRODUCING A FIBER MATERIAL WEB

(75) Inventors: Martin Tietz, Heidenheim (DE); Harald Schmidt-Hebbel, Sao Paulo (BR)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/213,894

(22) Filed: Dec. 17, 1998

(30) Foreign Application Priority Data

Dec. 18, 1997 (DE) ..... 197 56 422

(51) Int. Cl.[7] ..... D21F 3/00; D21H 11/00; B31F 1/12; B31F 1/29

(52) U.S. Cl. ..... 162/358.5; 162/281; 162/361; 162/358.3

(58) Field of Search ..... 162/301, 111, 162/281, 361, 205, 358.5, 358.3, 206, 207, 359.1, 290

(56) References Cited

U.S. PATENT DOCUMENTS

| | | | |
|---|---|---|---|
| 4,556,454 | 12/1985 | Dahl et al. . | |
| 4,988,410 | 1/1991 | Meinecke et al. . | |
| 5,393,384 | 2/1995 | Steiner et al. . | |
| 5,404,811 | 4/1995 | Schiel et al. . | |
| 5,439,559 | 8/1995 | Crouse . | |
| 5,495,050 | 2/1996 | Wakasugi et al. . | |
| 5,556,511 | 9/1996 | Bluhm et al. . | |
| 5,711,854 * | 1/1998 | Schiel et al. | 162/358.3 |

FOREIGN PATENT DOCUMENTS

| | | |
|---|---|---|
| 331113 | 8/1976 | (DE) . |
| 3408119 | 8/1985 | (DE) . |
| 4224730 | 9/1993 | (DE) . |
| 4216264 | 11/1993 | (DE) . |
| 0658534 | 6/1995 | (EP) . |
| 2218122 | 11/1989 | (GB) . |
| 93/12289 | 6/1993 | (WO) . |
| 97/16593 | 5/1997 | (WO) . |

* cited by examiner

*Primary Examiner*—Stanley S. Silverman
*Assistant Examiner*—Dionne A. Walls
(74) *Attorney, Agent, or Firm*—Greenblum & Bernstein, P.L.C.

(57) ABSTRACT

Machine and process for producing a fiber material web that includes at least one press device having a shoe press unit and a drying drum, such that the shoe press unit and the drying drum are positioned to form an elongated press nip. The machine also includes at least one belt that is water-permeable and water-absorbent and that is adapted to guide the fiber material web through the press nip, and at least one suction device located ahead of the elongated press nip, relative to a belt travel direction. The at least one belt is guided over the at least one suction device. The process includes guiding the at least one belt over the at least one suction device and suctioning the at least one belt, such that moisture is removed from the at least one belt, and guiding the fiber material web and the suctioned at least one belt through the extended press nip.

26 Claims, 1 Drawing Sheet

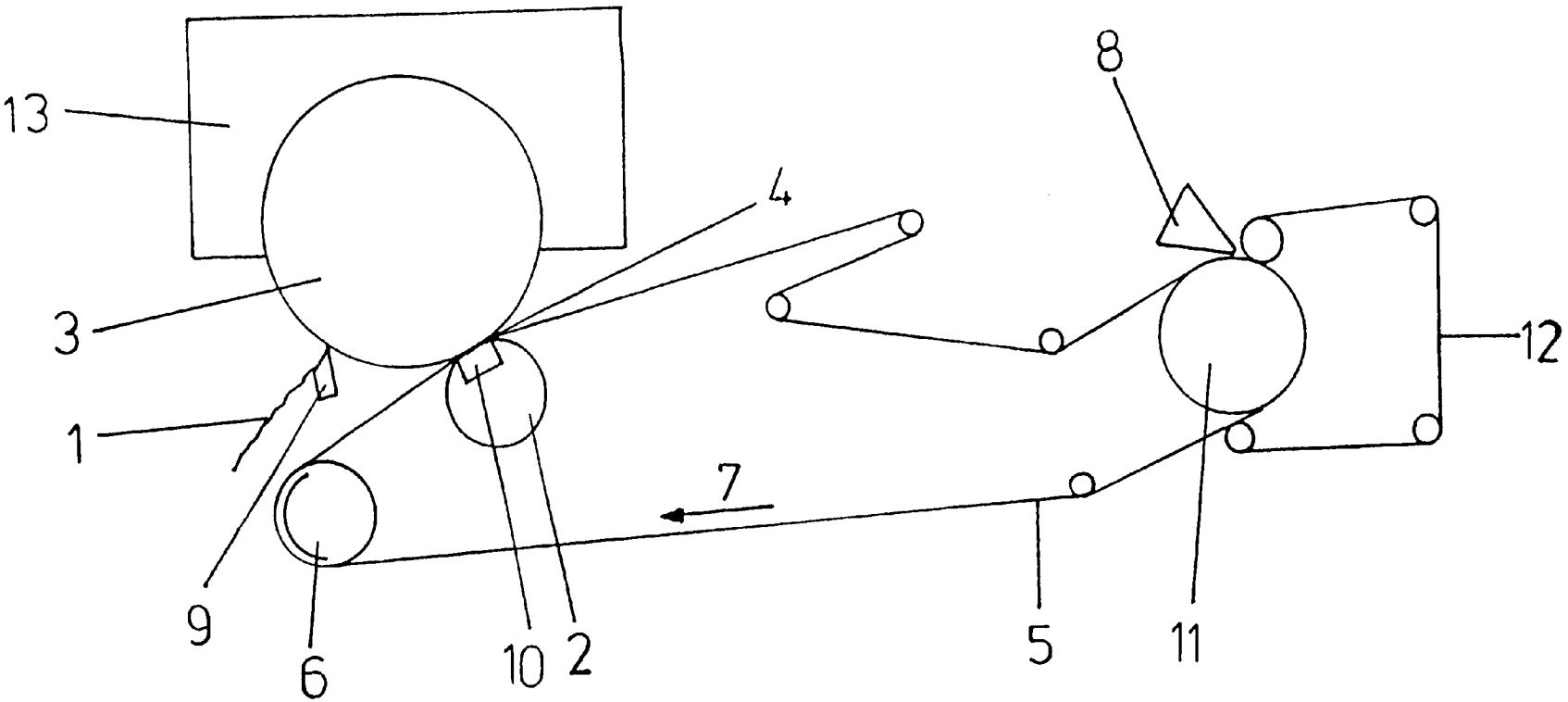
12
8
11
5
4
7
2
10
6
9
13
3
1

MACHINE AND PROCESS FOR PRODUCING A FIBER MATERIAL WEB

CROSS-REFERENCE TO RELATED APPLICATIONS

The present application claims priority under 35 U.S.C. § 119 of German Patent Application No. 197 56 422.4, filed on Dec. 18, 1997, the disclosure of which is expressly incorporated by reference herein in its entirety.

BACKGROUND OF THE INVENTION

1. Field of the Invention

The present invention relates to a machine for producing a fiber material web, e.g., a tissue paper web. The machine includes at least one press having a shoe press unit and a drying drum that form an elongated press gap.

2. Discussion of Background Information

German patent document DE-OS 42 24 730, e.g., discloses a machine similar in general to the machine discussed above in which a fiber material web is guided over at least one additional upstream press gap for draining. In this manner, the fiber material web is guided, together with a water resistant or waterproof belt, between two press gaps.

In this regard, shoe press units offer the advantage of effective and volume-preserving drainage, which is of particular significance in the manufacture of tissue papers. While the degree of draining depends on the press impulse as an integral of press pressure over press time, the influence on volume is determined by the maximum pressure in the press zone. In this process, transport from the wire former of the machine through the two press locations is performed with the waterproof belt. While this belt does prevent remoistening of the fiber material web, because of its lack of water absorption capacity, the belt cannot contribute to drainage in the press locations. For this reason, a water-absorbent felt is guided through the upstream press gap. Thus, drainage primarily occurs in this press gap. Therefore, these machines are unsatisfactory not only with respect to their draining performance, but also with respect to cost.

SUMMARY OF THE INVENTION

The present invention provides a machine for producing a fiber material web, e.g., a tissue paper web. The machine may be simply designed while enabling as intense and volume-preserving drainage as possible.

The present invention provides a machine that includes at least one water-permeable and water-absorbent belt, e.g., a sieve or screen, a felt, or similar material, that is guided through a press nip or gap with the fiber material web, and over at least one suction device located ahead of the press nip.

Via the suction device, it is possible to remove enough water from the belt and, if applicable, from the fiber material web so that the water absorption capacity of the belt may be sufficient to absorb the water pressed out of the fiber material web in the press nip. Moreover, remoistening of the fiber material web may be reduced.

Thus, the machine in accordance with the present invention may be a simply designed machine that operates efficiently even with only one press nip. Moreover, the belt may be utilized in a former part of the machine for taking up or receiving a fiber material suspension from a material feed device. In this manner, transferring of the fiber material web between different belts may be avoided. Further, a drying drum, e.g., a tissue drying drum, may be provided, and the fiber material web may scraped off the surface of the tissue drying drum, i.e., after drying, with, e.g., a crepe scraper.

The belt may be guided with the fiber material web across or over the suction device such that the fiber material web is located on an outside surface of the belt, i.e., a surface of the belt not in contact with the suction device. The suction device may be composed of a suction roll, however, one or more suction boxes may also be utilized.

Suction rolls may generally include a perforated roll sleeve having a negative pressure created within the roll sleeve either by direct connection to a suction (vacuum) source or by suctioning an area of the roll not covered by the belt. The suction rolls in accordance with the present invention may be more simply constructed than the suction press rolls generally utilized in the prior art arrangement because the prior art suciton rolls are constructed to be more stable and generally require support elements.

It may be particularly advantageous for the shoe press unit to include a plurality of press zones extending laterally to a web travel direction. Further, the plurality of press zones may be controlled independently of each other. In this manner, a desired cross directional profile of the press pressure, i.e., transverse to the web travel direction, may be set independently of any deflection of the drying drum. Consequently, it is not necessary to camber the drying drum, which simplifies its manufacture.

Moreover, an increased temperature of the drying drum may ensure that the viscosity of the water is reduced in the press gap, thereby improving drainage.

The present invention is directed to a machine for producing a fiber material web that includes at least one press device having a shoe press unit and a drying drum, such that the shoe press unit and the drying drum are positioned to form an elongated press nip. The machine also includes at least one belt that is water-permeable and water-absorbent and that is adapted to guide the fiber material web through the press nip, and at least one suction device located ahead of the elongated press nip, relative to a belt travel direction. The at least one belt is guided over the at least one suction device.

In accordance with another feature of the present invention, the at least one belt may be further adapted to guide the fiber material web over the at least one suction device on a belt surface that is directed away from the at least one suction device.

In accordance with another feature of the present invention, the shoe press unit may be composed of a plurality of press zones that extend transversely to the belt travel direction, and the plurality of press zones may be independently controllable independently of each other.

In accordance with another feature of the present invention, the at least one suction device may include a suction roll.

In accordance with another feature of the present invention, a former section including a material feed device may be provided, and the at least one belt may be guided through the former section and may be adapted to receive a fiber material suspension from the material feed device.

In accordance with another feature of the present invention, a crepe scraper may be provided, and the drying drum may be a tissue drying drum. The crepe scraper may be positioned against the tissue drying drum and be adapted to remove the fiber material web from the tissue drying drum after drying. Further, the tissue drying drum may include a dryer hood.

In accordance with another feature of the present invention, the material web may include a tissue paper web.

In accordance with another feature of the present invention, the at least one suction device may include at least one suction box.

In accordance with another feature of the present invention, the at least one belt may be composed of one of a sieve and a felt.

The present invention may also be directed to a process for producing a fiber material web in a machine that includes at least one press device having an extended press nip formed between a shoe press unit and a drying drum, at least one belt that is water-permeable and water-absorbent, and at least one suction device located in front of the elongated press nip, relative to a belt travel direction. The process includes guiding the at least one belt over the at least one suction device and suctioning the at least one belt, such that moisture is removed from the at least one belt, and guiding the fiber material web and the suctioned at least one belt through the extended press nip.

In accordance with another feature of the present invention, the process may include guiding the fiber material web and the at least one belt over the at least one suction device before being guided through the extended press nip. Further, the process may include guiding the fiber material web on a surface of the at least one belt that is directed away from the at least one suction device.

In accordance with another feature of the present invention, the process further includes setting a cross directional pressure profile for the extended press nip. Further, the process may include adjusting the cross directional pressure profile in accordance with a deflection of the drying drum.

In accordance with another feature of the present invention, the machine may include a former section, and before guiding the at least one belt over the at least one suction device, the process may further include supplying a fiber material suspension onto a surface of the at least one belt in the former section. Further, the process may include guiding the fiber material suspension over the at least one suction device. The at least one belt may be arranged between the fiber material suspension and the at least one suction device.

In accordance with another feature of the present invention, the process further including removing the fiber material web from the at least one belt, such that the fiber material web adheres to the drying drum, and guiding the fiber material web on the drying drum through a drying hood. Further, the process includes removing the fiber material web from the drying drum with a crepe scraper located downstream of the drying hood.

In accordance with another feature of the present invention, the process further including removing the fiber material web with a crepe scraper. The fiber material web is composed of a tissue paper web.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein:

The FIGURE schematically illustrates a machine for producing a fiber material web in accordance with the features of the present invention.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The FIGURE schematically illustrates a partial view of a machine for producing a fiber material web, e.g., a tissue paper web. A continuous belt 5, e.g., a felt, and a continuous former sieve or screen 12 may be guided together over a portion of a former roll 11. Belt 5 traverses a greater portion of an outer surface of former roll 11 than former sieve 12. A fiber material suspension may be fed into a feed gap formed between belt 5 and former sieve 12 with a material feed device 8, which is known in the art, to form a fiber material web 1. Fiber material web 1 may be guided by belt 5 to, and through, an elongated press nip or gap 4 arranged downstream from a belt contact area of former roll 11. Before being guided through press nip 4, belt 5 may be guided over a suction device 6, e.g., a suction roll or a plurality of suction boxes. Suction device 6 may be utilized to remove a significant portion of the water from belt 5 and, if necessary, to some extent from fiber material web 1, located on the outer surface of belt 5. In this manner, the water absorption capacity of belt 5 may be significantly increased so as to absorb water pressed out in elongated press nip 4, as belt 5 and fiber material web 1 are guided therethrough. Thus, the arrangement of the present invention intensifies drainage such that sufficient drainage may be provided with one elongated press nip 4.

Elongated press nip 4 may be formed by, e.g., a drying drum 3, e.g., a tissue drying drum, and a shoe press unit 2. Shoe press unit 2 may include a flexible roll sleeve or jacket and a press device 10. Press device 10 may have a concave press surface formed by a contact press shoe. Contact pressure between the inner surface of the roll jacket and the contact press shoe may be hydraulically provided, and lubrication between the roll jacket and contact press shoe may be hydrostatically and/or hydrodynamically provided. Shoe press unit 2 may include a plurality of press zones, which may be controlled independently of each. Further, the plurality of press zones may be arranged to extend transversely to a web travel direction 7. In this manner, adjustment of individual press zones may be made in accordance with any deflection of drying drum 3, and a desired cross directional press pressure profile of fiber material web 1, i.e., transerse, and preferably substantially perpendicular, to web travel direction 7, may be set. Elongated press nip 4 enables an intensive and volume-preserving drainage of fiber material web 1.

Downstream from press nip 4, fiber material web 1 may adhere to heated drying drum 3. Drying may be further intensified, e.g., in an area of contact between fiber material web 1 and drying drum 3, via a drying hood 13 that blows hot dry air onto fiber material web 1 and that exhausts the air.

After drying fiber material web 1, fiber material web 1 may be removed from drying drum 3 by, e.g., a crepe scraper 9, which is known in the art. The creped fiber material web 1 may then be further processed and rolled in a manner known in the art.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A machine for producing a fiber material web comprising:

at least one press device comprising a shoe press unit and a drying drum, the shoe press unit and the drying drum being positioned to form an elongated press nip;

at least one belt that is water-permeable and water-absorbent and that is adapted to guide the fiber material web through the press nip;

a doctor positioned adjacent the drying drum adapted to remove the web from the drying drum;

at least one suction device located ahead of the elongated press nip, relative to a belt travel direction;

the at least one belt being guided over the at least one suction device;

a former section including a material feed device; and the at least one belt being guided through the former section and adapted to receive a fiber material suspension from the material feed device.

2. The machine in accordance with claim 1, the at least one belt being further adapted to guide the fiber material web over the at least one suction device on a belt surface directed away from the at least one suction device.

3. The machine in accordance with claim 1, the shoe press unit being composed of a plurality of press zones that extend transversely to the belt travel direction; and the plurality of press zones being controllable independently of each other.

4. The machine in accordance with claim 1, the at least one suction device comprising a suction roll.

5. The machine in accordance with claim 1, wherein the drying drum is a tissue drying drum, and the doctor is positioned against the tissue drying drum and is adapted to remove the fiber material web from the tissue drying drum after drying.

6. The machine in accordance with claim 5, the tissue drying drum including a dryer hood.

7. The machine in accordance with claim 1, the material web comprising a tissue paper web.

8. The machine in accordance with claim 1, the at least one suction device comprising at least one suction box.

9. The machine in accordance with claim 1, the at least one belt comprising one of a sieve and a felt.

10. The machine in accordance with claim 1, wherein the at least one suction device comprises a suction roll, which is not part of the at least one press device.

11. A process for producing a fiber material web in a machine that includes at least one press device having an extended press nip formed between a shoe press unit and a drying drum, at least belt that is one water-permeable and water-absorbent, and at least one suction device located ahead of the elongated press nip, relative to a belt travel direction, and includes a former section, the process comprising:

guiding the at least one belt over the at least one suction device and suctioning the at least one belt, whereby moisture is removed from the at least one belt;

guiding the fiber material web and the suctioned at least one belt through the extended press nip; and removing the web from the dryer drum with a doctor, wherein, before guiding the at least one belt over the at least one suction device, the process further comprises: supplying a fiber material suspension onto a surface of the at least one belt in the former section.

12. The process in accordance with claim 11, guiding the fiber material web and the at least one belt over the at least one suction device before being guided through the extended press nip.

13. The process in accordance with claim 12, guiding the fiber material web on a surface of the at least one belt directed away from the at least one suction device.

14. The process in accordance with claim 11, further comprising:

setting a cross directional pressure profile for the extended press nip.

15. The process in accordance with claim 14, further comprising:

adjusting the cross directional pressure profile in accordance with a deflection of the drying drum.

16. The process in accordance with claim 11, further comprising:

guiding the fiber material suspension over the at least one suction device, wherein the at least one belt is arranged between the fiber material suspension and the at least one suction device.

17. The process in accordance with claim 11, further comprising:

removing the fiber material web from the at least one belt, whereby the fiber material web adheres to the drying drum; and guiding the fiber material web on the drying drum through a drying hood.

18. The process in accordance with claim 17, further comprising:

removing the fiber material web from the drying drum with the doctor, which is located downstream of the drying hood.

19. The process in accordance with claim 11, further comprising:

removing the fiber material web with a crepe scraper, wherein the fiber material web is composed of a tissue paper web.

20. The process in accordance with claim 11, wherein the at least one suction device comprises a suction roll, which does not form part of the extended nip.

21. A machine for producing a fiber material web comprising:

at least one press device comprising a shoe press unit and a drying drum, the shoe press unit and the drying drum being positioned to form an elongated press nip;

at least one belt that is water-permeable and water-absorbent and that is adapted to guide the fiber material web through the press nip;

at least one suction roll located ahead of the elongated press nip, relative to a belt travel direction;

a doctor positioned adjacent the drying drum adapted to remove the web from the drying drum;

the at least one belt being guided over the at least one suction roll, and being adapted to guide the fiber material web over the at least one suction roll on a belt surface directed away from the at least one suction device;

a former section including a material feed device; and the at least one belt being guided through the former section and adapted to receive a fiber material suspension from the material feed device.

22. The machine in accordance with claim 21, wherein the drying drum is a tissue drying drum, and the doctor is positioned against the tissue drying drum and is adapted to remove the fiber material web from the tissue drying drum after drying.

23. A process for producing a fiber material web in a machine that includes at least one press device having an extended press nip formed between a shoe press unit and a drying drum, at least belt that is one water-permeable and water-absorbent, and at least one suction roll located ahead of the elongated press nip, relative to a belt travel direction, and that includes a former section, the process comprising:

guiding the at least one belt over the at least one suction roll and suctioning the at least one belt, whereby moisture is removed from the at least one belt;

guiding the fiber material web and the suctioned at least one belt through the extended press nip;

guiding the fiber material web and the at least one belt over the at least one suction roll before being guided through the extended press nip;

guiding the fiber material web on a surface of the at least one belt directed away from the at least one suction device; and separating the web from the at least one belt, whereby the web adheres to the drying drum, wherein, before guiding the at least one belt over the at least one suction roll, the process further comprises:

supplying a fiber material suspension onto a surface of the at least one belt in the former section;

removing the fiber material web from the at least one belt, whereby the fiber material web adheres to the drying drum; and guiding the fiber material web on the drying drum through a drying hood.

24. The process in accordance with claim 23, further comprising:

setting a cross directional pressure profile for the extended press nip; and adjusting the cross directional pressure profile in accordance with a deflection of the drying drum.

25. The process in accordance with claim 23, further comprising:

removing the fiber material web with a crepe scraper, wherein the fiber material web is composed of a tissue paper web.

26. The process in accordance with claim 23, further comprising:

removing the fiber material web from the drying drum with a crepe scraper located downstream of the drying hood.

* * * * *